US006377187B1

(12) United States Patent
Fong

(10) Patent No.: US 6,377,187 B1
(45) Date of Patent: Apr. 23, 2002

(54) LEVEL/POSITION SENSOR AND RELATED ELECTRONIC CIRCUITRY FOR INTERACTIVE TOY

(76) Inventor: Peter Sui Lun Fong, 297F S. Atlantic Blvd., Monterey Park, CA (US) 91754

( * ) Notice: Subject to any disclaimer, the term of this patent is extended or adjusted under 35 U.S.C. 154(b) by 0 days.

(21) Appl. No.: 09/478,388

(22) Filed: Jan. 6, 2000

(51) Int. Cl.[7] ..... G08B 21/00

(52) U.S. Cl. ..... 340/686.1; 340/573.1; 200/61.52

(58) Field of Search ..... 340/573.1, 589, 340/691.2; 200/61.45 R, 61.52, 61.48, 82 R, 6 A, 6 B, 6 C; 73/649, 651, 652, 654, 653, 655, 657

(56) References Cited

U.S. PATENT DOCUMENTS

| | | | | | |
|---|---|---|---|---|---|
| 3,601,729 | A | | 8/1971 | Hierta | |
| 4,321,438 | A | | 3/1982 | Emenegger | |
| 4,339,747 | A | | 7/1982 | Maybee | |
| 4,390,928 | A | | 6/1983 | Runge | |
| 4,503,299 | A | * | 3/1985 | Henrard et al. | 200/61.52 |
| 4,803,342 | A | * | 2/1989 | Steers et al. | 219/257 |
| 4,866,850 | A | | 9/1989 | Kelly et al. | |
| 4,925,189 | A | * | 5/1990 | Braeunig | 27/148 B |
| 5,001,466 | A | * | 3/1991 | Orlinsky et al. | 340/690 |
| 5,130,693 | A | | 7/1992 | Gigandet | |
| 5,168,264 | A | * | 12/1992 | Agustin | 340/573.7 |
| 5,195,746 | A | * | 3/1993 | Boyd et al. | 273/148 B |
| 5,209,343 | A | | 5/1993 | Romano et al. | |
| 5,300,921 | A | * | 4/1994 | Hoch et al. | 340/573.6 |
| 5,402,107 | A | * | 3/1995 | Rencavage | 340/573.7 |
| 5,450,049 | A | | 9/1995 | Bachmann | |
| 5,610,338 | A | | 3/1997 | Kato et al. | |
| 5,694,340 | A | * | 12/1997 | Kim | 701/141 |
| 5,703,567 | A | * | 12/1997 | Cleveland | 340/686.1 |
| 5,992,849 | A | | 11/1999 | Olti et al. | |
| 6,106,398 | A | * | 8/2000 | Davis | 463/38 |
| 6,157,898 | A | | 12/2000 | Marinelli | |

* cited by examiner

*Primary Examiner*—John A. Tweel
(74) *Attorney, Agent, or Firm*—Mark B. Garred; Stetina Brunda Garred & Brucker

(57) ABSTRACT

A sensor for use in an interactive electronic device and operative to generate a plurality of different output signals corresponding to respective positions of the sensor relative to a plane. The sensor comprises a base mount having a first switch attached thereto and including at least three leaf contacts extending in juxtaposed relation to each other. Movably attached to the base mount is a first actuator which is cooperatively engaged to one of the leaf contacts of the first switch. The first actuator normally extends along a first axis and is movable relative thereto from a home position whereat none of the leaf contacts of the first switch contact each other to a trigger position whereat the leaf contact to which the first actuator is cooperatively engaged contacts at least one other leaf contact of the first switch. The sensor further includes a second switch which is also attached to base mount and identically configured to the first switch, and a second actuator which also movably attached to the base mount and identically configured to the first actuator. The second actuator, which is cooperatively engaged to one of the leaf contacts of the second switch, normally extends along a second axis which extends in generally perpendicular relation to the first axis, and is itself movable relative to the second axis between the home and trigger positions.

24 Claims, 11 Drawing Sheets

LEVEL/POSITION SENSOR AND RELATED ELECTRONIC CIRCUITRY FOR INTERACTIVE TOY

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to interactive electronic toys, and more particularly to a uniquely configured sensor and associated electronic circuitry which may be incorporated into interactive electronic toys and games (including dolls and remote controllers such as joysticks) and is operative to produce various visual and/or audible outputs or signal transmissions corresponding to the level/position of the toy relative to a prescribed plane.

There is currently known in the prior art a multitude of interactive electronic toys which are capable of producing a wide variety of visual and/or audible outputs. In the prior art toys, these outputs are typically triggered as a result of the user (e.g., a child) actuating one or more switches of the toy. The switch(es) of the prior art toys are most typically actuated by pressing one or more buttons on the toy, opening and/or closing a door or a hatch, turning a knob or handle, inserting an object into a complimentary receptacle, etc. In certain prior are interactive electronic toys, the actuation of the switch is facilitated by a specific type of movement of the toy. However, in those prior art electronic toys including a motion actuated switch, such switch is typically capable of generating only a single output signal as a result of the movement of the toy.

The present invention provides a uniquely configured sensor and associated electronic circuitry which is particularly suited for use in interactive electronic toys and games, including dolls and remote controllers such a joysticks. The present sensor is specifically configured to generate a multiplicity of different output signal which are a function of (i.e., correspond to) the level/position of the toy relative to a prescribed plane. Thus, interactive electronic toys and games incorporating the sensor and associated electronic circuitry of the present invention are far superior to those known in the prior art since a wide variety of differing visual and/or audible outputs and/or various signal transmissions may be produced simply by varying or altering the level/position of the toy relative to a prescribed plane. For example, the incorporation of the sensor and electronic circuitry of the present invention into an interactive electronic toy such as a spaceship allows for the production of differing visual and/or audible outputs as a result of the spaceship being tilted in a nose-up direction, tilted in a nose-down direction, banked to the left, and banked to the right. As indicated above, the output signals generated by the sensor differ according to the level/position of the sensor relative to a prescribed plane, with the associated electronic circuitry of the present invention being operative to facilitate the production of various visual and/or audible outputs corresponding to the particular output signals generated by the sensor.

If incorporated into a joystick or other remote controller, the present sensor and associated electronic circuitry may be configured to facilitate the production of the aforementioned visual and/or audible outputs, and/or generate radio signals, infrared signals, microwave signals, or combinations thereof which may be transmitted to another device to facilitate the control and operation thereof in a desired manner. The frequency of the radio, infrared, or microwave signals transmitted from the joystick or other remote controller would be variable depending upon the level or position of the same relative to a prescribed plane. Moreover, the present electronic circuitry may be specifically programmed to memorize or recognize a prescribed sequence of movements of the sensor relative to a prescribed plane. More particularly, a prescribed sequence of output signals generated by the sensor corresponding to a prescribed sequence of movements thereof, when transmitted to the electronic circuitry, may be used to access a memory location in the electronic circuitry in a manner triggering or implementing one or more pre-programmed visual and/or audible functions or effects and/or the transmission of various infrared, radio, or microwave signals to another device for communication and/or activation of various functions thereof. These, and other unique attributes of the present invention, will be discussed in more detail below.

BRIEF SUMMARY OF THE INVENTION

The present invention relates generally to a sensor which may be disposed within an interactive electronic device and is operative to generate no output signal when the device resides on a device plane which extends in generally parallel relation to a reference plane. The sensor is further operative to generate at least one output signal when the device is moved to reside on a function plane which extends in non-parallel relation to the reference plane. The device may be moved so as to reside on any one of a multiplicity of function planes which each extend in non-parallel relation to the reference plane, with the sensor being operative to generate a multiplicity of different output signals corresponding to respective ones of the function planes. The present sensor is preferably used in combination with programmable electronic circuitry which is in electrical communication therewith, and programmed to translate the absence of an output signal and any output signals generated by the sensor into respective effects. These effects may comprise visual and/or audible outputs, infrared signals of differing frequencies, radio signals of differing frequencies, microwave signals of differing frequencies, or combinations thereof. Additionally, the electronic circuitry may be programmed to produce a selected effect upon a prescribed sequence of output signals being transmitted thereto from the sensor.

More particularly, in accordance with the present invention, there is provided a sensor for use in an interactive electronic device, such as a toy, doll, remote controller or joystick. As indicated above, the present sensor is operative to generate a multiplicity of different output signals corresponding to respective positions of the sensor relative to a plane. In a first embodiment of the present invention, the sensor is a two-axis type and comprises a base mount having a first switch attached thereto. The first switch includes at least two leaf contacts which extend in spaced, generally parallel relation to each other. Movably attached to the base mount is a first actuator of the sensor which is cooperatively engaged to one of the leaf contacts of the first switch. The first actuator normally extends along a first axis and is movable relative thereto from a home position whereat none of the leaf contacts of the first switch contact each other, to a trigger position whereat the leaf contact to which the first actuator is cooperatively engaged contacts at least one other leaf contact of the first switch.

The sensor of the first embodiment further comprises a second switch which is also attached to the base mount. The second switch is identically configured to the first switch and includes at least two leaf contacts extending in spaced, generally parallel relation to each other. Also included in the sensor is a second actuator which is also movably attached to the base mount and is identically configured to first actuator. In this respect, the second actuator is cooperatively engaged to one of the leaf contacts of the second switch and normally extends along a second axis which extends in non-parallel (and preferably perpendicular) relation to the first axis. The second actuator is movable relative to the second axis from a home position whereat none of the leaf contacts of the second switch contact each other, to a trigger position whereat the leaf contact to which the second actuator is cooperatively engaged contacts at least one other leaf contact of the second switch.

The sensor of the first embodiment is configured such that when the first and second axes extend in generally parallel relation to the plane, the first and second actuators are each disposed in the home position resulting in no output signal being generated by the sensor. The movement of the sensor in a manner wherein at least one of the first and second axes extends in non-parallel relation to the plane causes at least one of the first and second actuators to move to the trigger position resulting in at least one output signal being generated by the sensor.

The first and second switches of the sensor of the first embodiment each preferably comprise a center leaf contact which is disposed between a pair of outer leaf contacts. Each of the leaf contacts defines a distal end, with the center leaf contact of each of the first and second switches having a length exceeding those of the outer leaf contacts thereof, such that the distal end the center leaf contact of each of the first and second switches protrudes beyond the distal ends of the remaining leaf contacts in the same switch. The first and second actuators each preferably comprise a first end having a recess formed therein which is sized and configured to receive the distal end of the center leaf contact of a respective one of the first and second switches. The first and second actuators each further comprise a second end having a counter-weight attached thereto, and a central hub which is disposed between the first and second ends and pivotally connected to the base mount via a fastener such as a pivot pin. The distal end of the center leaf contact which is received into the recess of a respective one of the first and second actuators may be provided with a protective sheath which is attached thereto.

As indicated above, the sensor of the first embodiment may be used in combination with electronic circuitry which is in electrical communication therewith and operative to facilitate the production of the aforementioned effects or functions corresponding to the absence of an output signal and respective output signals generated by the sensor and transmitted to the electronic circuitry.

In accordance with a second embodiment of the present invention, there is provided a three-axis sensor which is identically configured to the two-axis sensor of the first embodiment, but further includes a third switch and a third actuator. The third switch, which is attached to the base mount, is identical to the first and second switches and includes at least two leaf contacts extending in spaced, generally parallel relation to each other. The third actuator, which is movably attached to the base mount, is itself identically configured to the first and second actuators, and is cooperatively engaged to one of the leaf contacts of the third switch. The third actuator normally extends along a third axis which extends in non-parallel (and preferably perpendicular) relation to the first and second axes, and movable relative to the third axis from a home position whereat none of the leaf contacts of third switch contact each other to a trigger position whereat the leaf contact to which the third actuator is cooperatively engaged contacts at least one other leaf contact of the third switch.

The sensor of the second embodiment is configured such that when the first and second axes extend in generally parallel relation to the plane simultaneously with the third axis extending in non-parallel (e.g., perpendicular) relation thereto, the first, second and third actuators are each disposed in the home position resulting in no output signal being generated by the sensor. The movement of the sensor of the second embodiment such that at least one of the first and second axes extends in non-parallel relation to the plane causes at least one of the first, second and third actuators to move to the trigger position resulting in at least one output signal being generated by the sensor.

The first and second switches of the sensor of the first embodiment and the first, second and third switches of the sensor of the second embodiment may alternately be configured to include five rather than three leaf contacts. More particularly, the first and second switches of the first embodiment and the first, second and third switches of the second embodiment may each comprise a center leaf contact disposed between two pairs of outer leaf contacts. In this alternative embodiment, it is contemplated that the center leaf contact of each switch will have a length exceeding those of the outer leaf contacts such that the distal end of the center leaf contact protrudes beyond the distal ends of the outer leaf contacts in the same switch. When the alternative five leaf contact switches are employed in the sensor of the first embodiment, the first and second actuators will preferably be cooperatively engaged to the center leaf contact of respective ones the first and second switches. Similarly, when the alternative five leaf contact switches are employed in the sensor of the second embodiment, the first, second and third actuators will preferably be cooperatively engaged to the center leaf contact of respective ones of the first, second and third switches. It is contemplated that the first and second switches of the sensor of the first embodiment and the first, second and third switches of the sensor of the second embodiment may comprise a combination of three and five leaf contact switches.

It is contemplated that the sensor of the present invention may be configured in a manner wherein an initial output signal is generated when the device resides on the device plane which extends in generally parallel relation to the reference plane, with the sensor further generating at least one supplemental output signal differing from the initial output signal when the device is moved to reside on function plane which extends in non-parallel relation to the reference plane. Since the device may be moved so as to reside on any one of a multiplicity of function planes which each extend in non-parallel relation to the reference plane, the sensor would be operative to generate a multiplicity of different supplemental output signals corresponding to respective ones of the function planes. The programmable electronic circuitry used in conjunction with the sensor and in electrical communication therewith would be programmed to translate the initial and supplemental output signals generated by the sensor into respective effects. Indeed, the electronic circuitry may be programmed such that the home or base position of the sensor is achieved when the device resides on the device plane or any one of the function planes, irrespective of whether any of the switches of the sensor ever assumes an open configuration attributable to the corresponding actuator being in its above-described home position.

BRIEF DESCRIPTION OF THE DRAWINGS

These, as well as other features of the present invention, will become more apparent upon reference to the drawings wherein:

FIG. 5*a* is a perspective view of a sensor constructed in accordance with a fourth embodiment of the present invention.

DETAILED DESCRIPTION OF THE INVENTION

Figure 1:
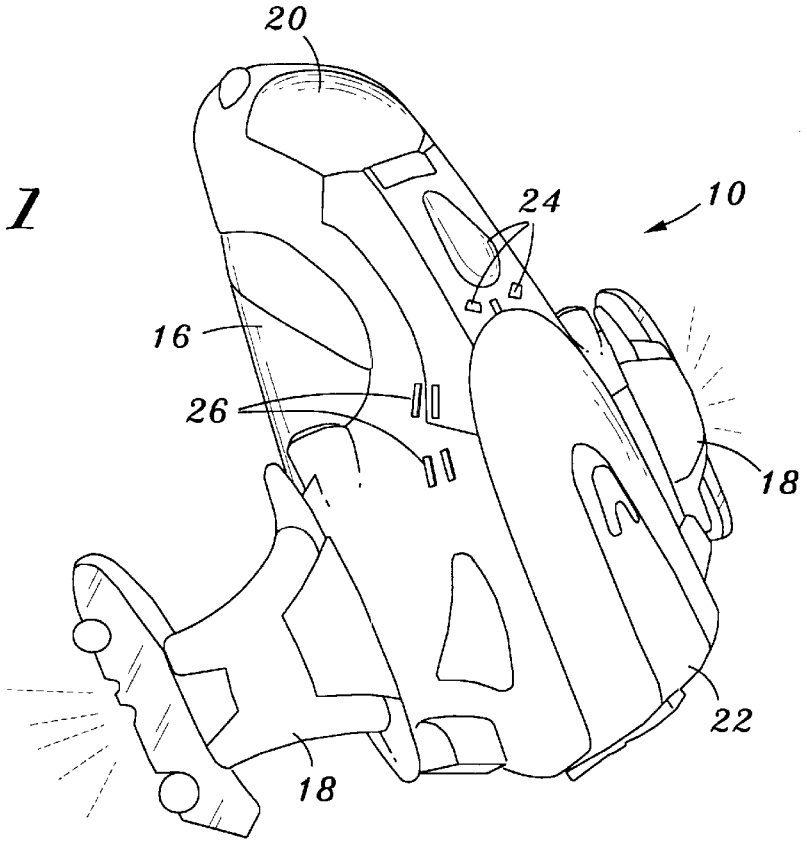
FIG. 1 is a perspective view of an exemplary interactive electronic toy incorporating the sensor and associated electronic circuitry of the present invention.
Figure 2:
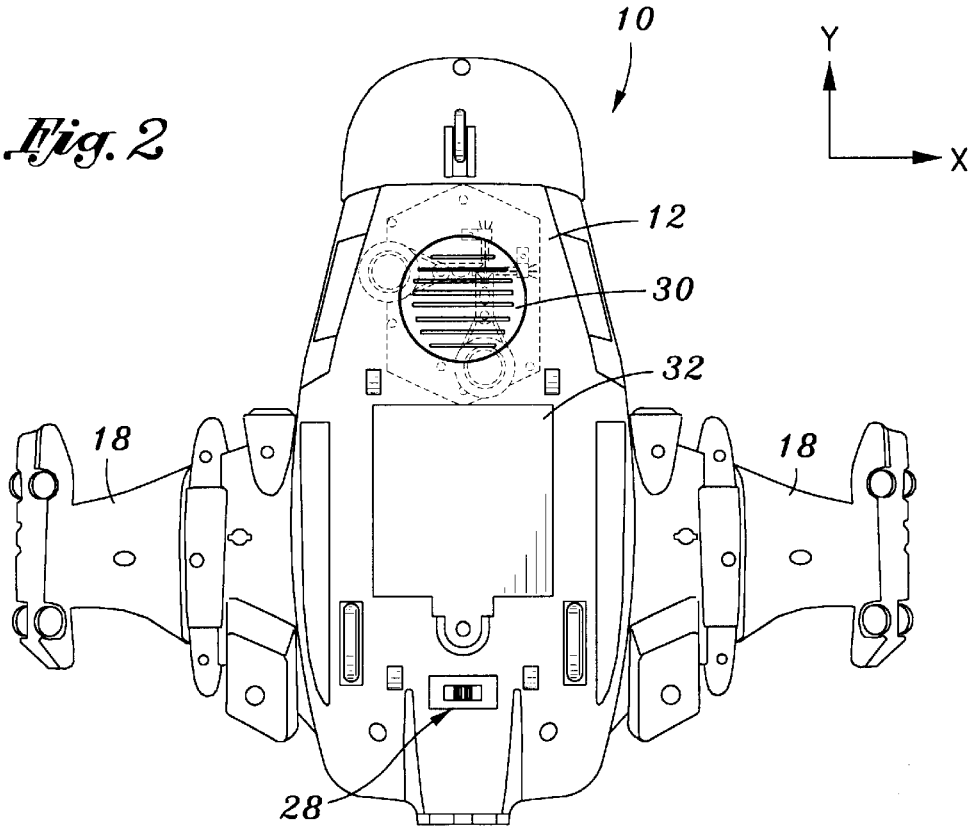
FIG. 2 is a bottom plan view of the interactive electronic toy shown in FIG. 1, further illustrating in phantom a sensor constructed in accordance with a first embodiment of the present invention.
Figure 9:
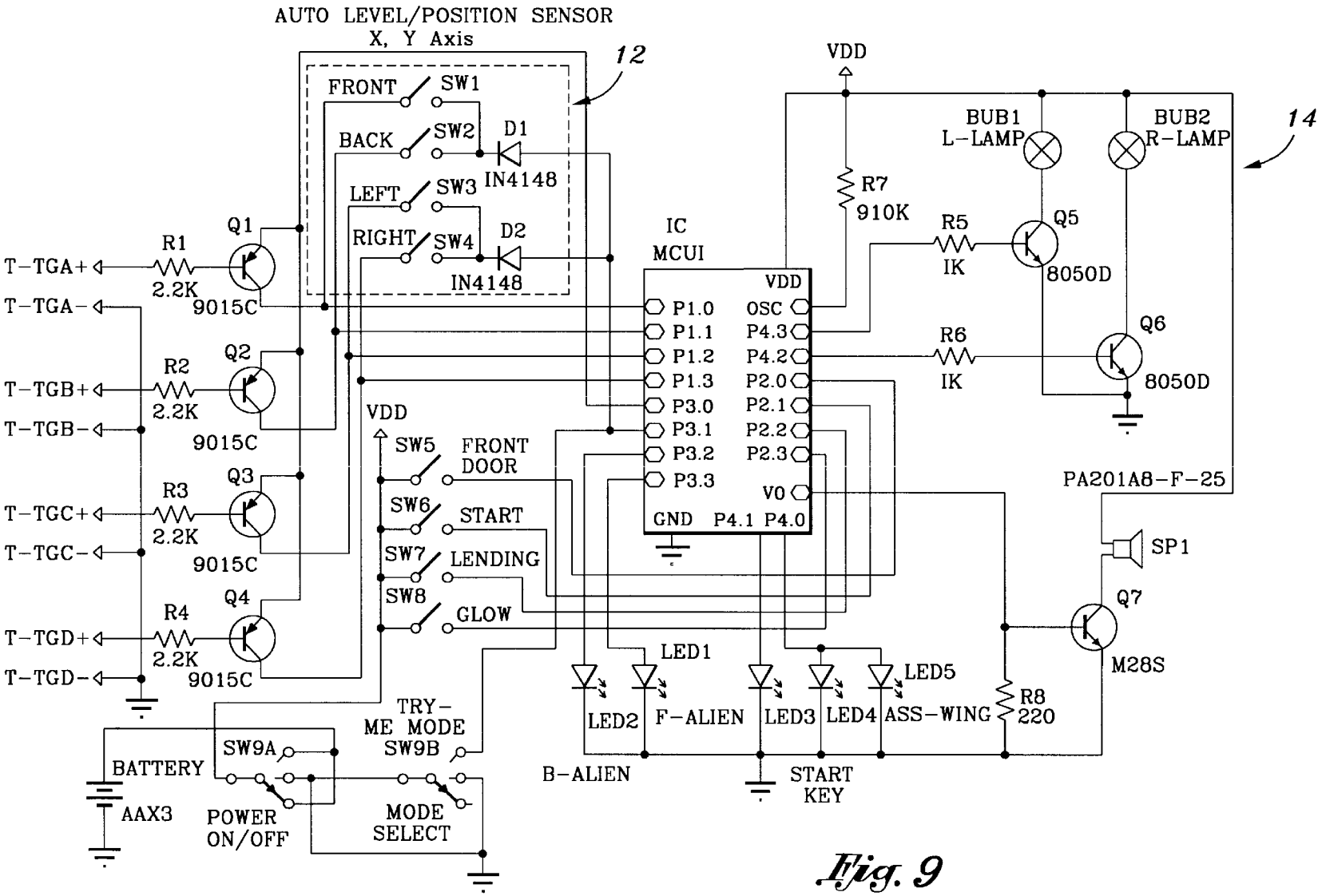
FIG. 9 is a schematic of exemplary electronic circuitry which may be used in conjunction with the sensor of the first embodiment for incorporation into an interactive electronic spaceship.

Referring now to the drawings wherein the showings are for purposes of illustrating preferred embodiments of the present invention only, and not for purposes of limiting the same, FIGS. 1 and 2 illustrate an exemplary interactive electronic toy (i.e., a spaceship 10) incorporating the sensor 12 of the first embodiment of the present invention (shown in FIGS. 3–5) and its associated electronic circuitry 14 (schematically illustrated in FIG. 9). Those of ordinary skill in the art will recognize that the sensor 12 of the first embodiment, as well as the sensor 112 of the second embodiment (shown in FIG. 6) may be incorporated into interactive electronic toys or games other than for the spaceship 10, or into interactive electronic devices other than for toys and games. For example, the sensor 12 or sensor 112 may be incorporated into an interactive doll or an interactive remote controller such as a joystick. As will be discussed in more detail below, different electronic circuitry is employed in relation to the present invention, depending on whether the sensor 12 or sensor 112 is incorporated into the interactive electronic device, and the particular type of switches employed in the sensor 12 or sensor 112.

The spaceship 10 shown in FIGS. 1 and 2 includes a fuselage 16 having an opposed pair of collapsible wings 18 extending from respective sides thereof. Attached to the front of the fuselage 16 is an openable and closable front door 20, while attached to the top of the fuselage 16 is an openable and closable top door 22. The front door 20 is operatively coupled to a switch which is electrically connected to the electronic circuitry 14 and actuated by the movement of the front door 20 from its closed position (shown in FIG. 1) to its open position. Protruding from the top of the fuselage 16 are three (3) depressible buttons 24 which are each preferably located between the front and top doors 20, 22. The buttons 24 are operatively coupled to respective switches which are each electrically connected to the electronic circuitry 14. Also provided on the top of the fuselage 16 about the periphery of the top door 22 are four (4) contact regions 26 which are also each electrically connected to the electronic circuitry 14.

In addition to the aforementioned components, the spaceship 10 is also provided with an on/off switch 28 which is located in the bottom of the fuselage 16 thereof. The on/off switch 28 is electrically connected to the electronic circuitry 14 as well, and is moveable between three (3) different modes, including an on mode, an off mode, and a "try-me" mode. The sensor 12 is disposed within the interior of the fuselage 16 in relative close proximity to the nose thereof, as is best shown in FIG. 2. The electronic circuitry 14 is also disposed within the interior of the fuselage 16. Attached to the bottom of the fuselage 16 adjacent the sensor 12 is a speaker 30 which is electrically connected to the electronic circuitry 14 and operative to transmit or generate audible outputs from the spaceship 10.

Also disposed within the bottom of the fuselage 16 between the speaker 30 and on/off switch 28 is a battery compartment 32 which accommodates multiple batteries. The batteries stored within the battery compartment 32 are electrically connected to the electronic circuitry 14 and provide power thereto, as well as to the sensor 12 via the electronic circuitry 14. The spaceship 10 is also preferably outfitted with a plurality of LED's which are disposed within the fuselage 16, wings 18, buttons 24, and underneath the front and top doors 20, 22. These LED's are each electrically connected to the electronic circuitry 14, and receive power from the batteries within the battery compartment 32 via the electronic circuitry 14. As previously indicated, the spaceship 10 as described above is exemplary of only a single interactive electronic toy in which the sensor 12 or sensor 112 of the present invention may be included.

Figure 3:
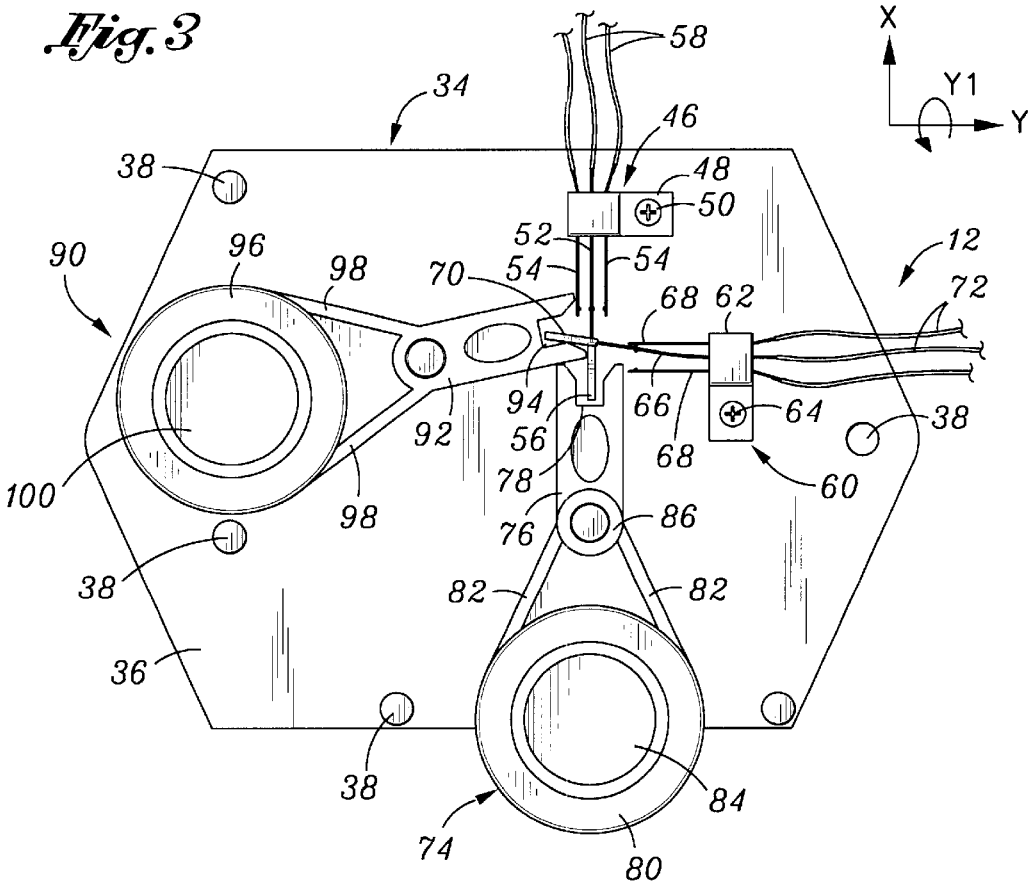
FIG. 3 is a top view of the sensor of the first embodiment, illustrating an exemplary manner in which one of the switches thereof is actuated to a trigger position by the movement of the sensor.
Figure 4:
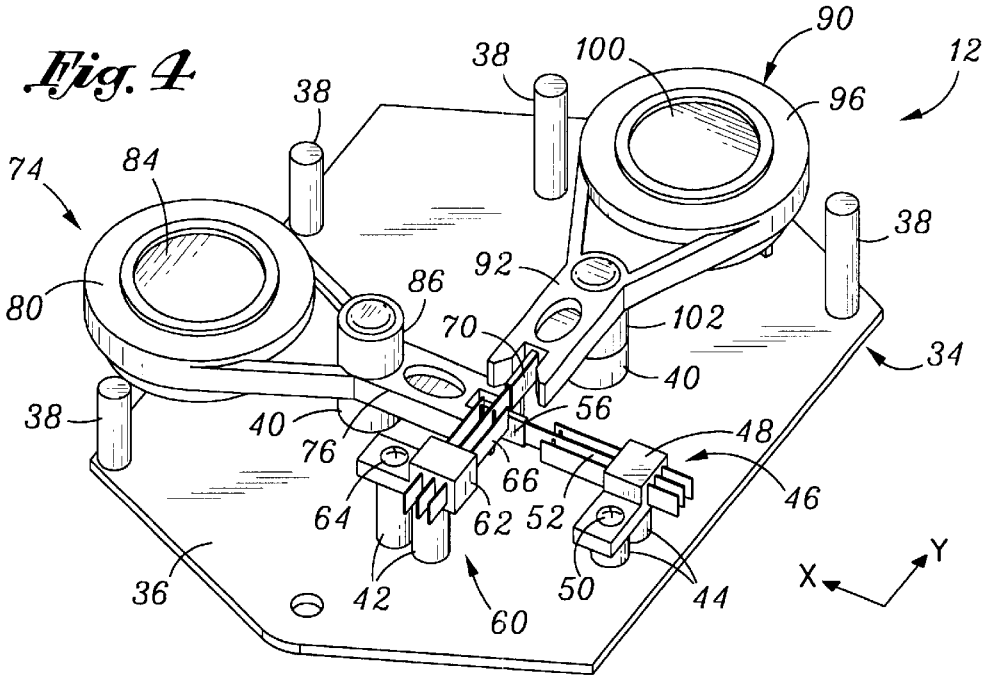
FIG. 4 is a perspective view of the sensor of the first embodiment.
Figure 5:
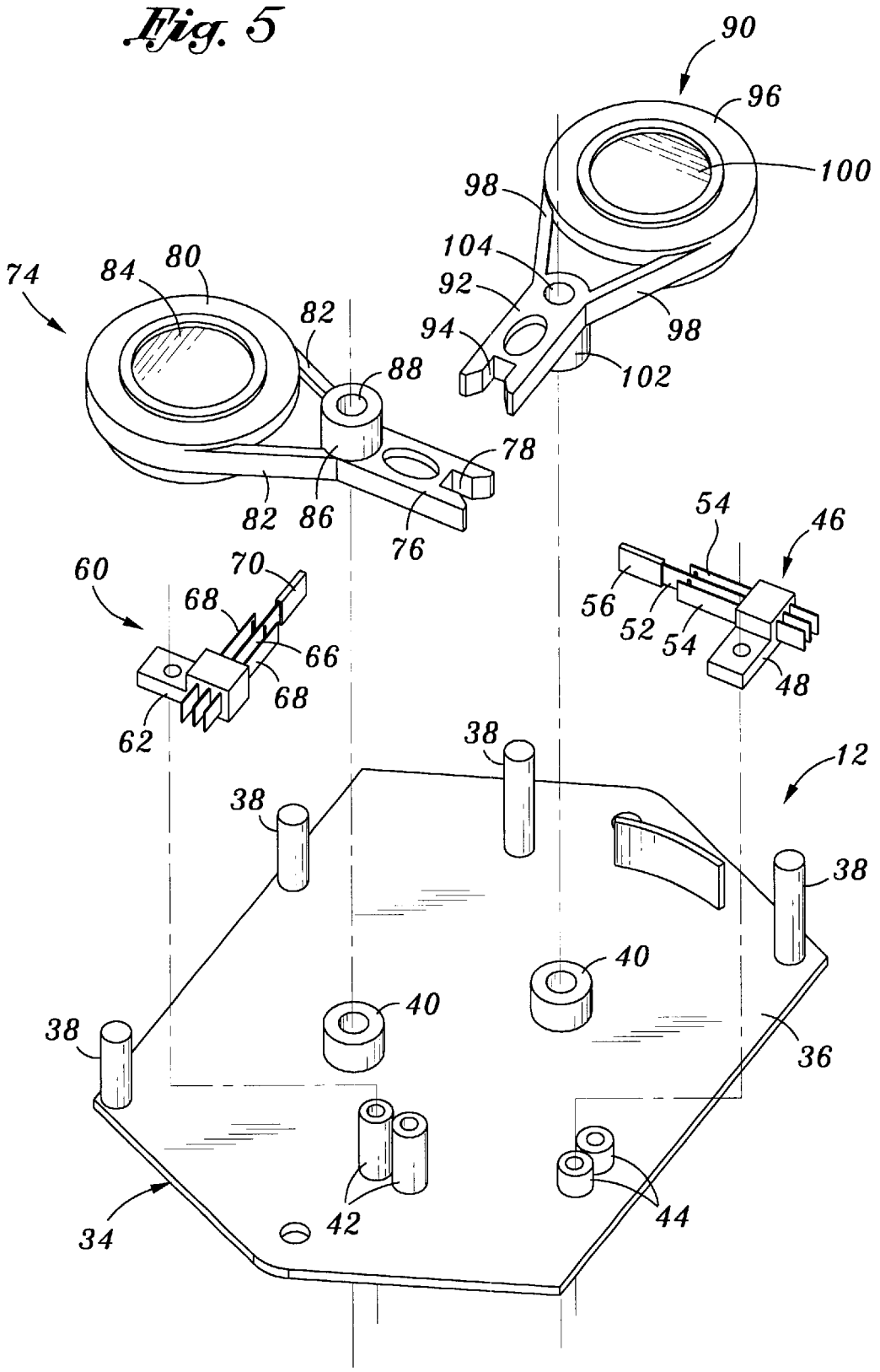
FIG. 5 is an exploded view of the sensor shown in FIG. 4.

Referring now to FIGS. 3–5, the sensor 12 of the first embodiment comprises a generally hexagonally configured base mount 34 which defines a first axis X and a second axis Y which extend in generally perpendicular relation to each other. The base mount 34 further defines a generally planar top surface 36 and includes a plurality of cylindrically configured pegs 38 which extend perpendicularly from the top surface 36 in generally parallel relation to each other. In addition to the pegs 38, the base mount 34 includes a first pair of tubular bosses 40, a second pair of tubular bosses 42, and a third pair of tubular bosses 44 which extend perpendicularly from the top surface 36 thereof in generally parallel relation to each other. The tubular bosses 40, 42, 44 of the first, second and third pairs, like the pegs 38, are integrally connected to the remainder of the base mount 34, and are used for reasons which will be discussed in more detail below. The entirety of the base mount 34 is preferably fabricated from a plastic material.

In addition to the base mount 34, the sensor 12 of the first embodiment comprises a first switch 46 which is attached to the base mount 34. More particularly, the first switch 46 comprises a switch body 48 which is positioned upon the tubular bosses 44 of the third pair, and secured thereto via the advancement of a fastener 50 such as a screw through the switch body 48 and into one of the tubular bosses 44 of the third pair. Attached to and extending perpendicularly from the switch body 48 are three (3) leaf contacts of the first switch 46, including a center leaf contact 52 which extends between and in spaced, generally parallel relation to a pair of outer leaf contacts 54. As is best seen in FIGS. 3 and 5, the center leaf contact 52 is of a length exceeding those of the outer leaf contacts 54 such that the distal end of the center leaf contact 52 protrudes beyond the distal ends of the outer leaf contacts 54. Attached to the distal end of the center leaf contact 52 is a protective sheath 56, the use of which will be discussed in more detail below. The center and outer leaf contacts 52, 54 are flexible and resilient, and fabricated from a metal material. Additionally, when the switch body 48 is positioned upon and secured to the tubular bosses 44 of the third pair, the center leaf contact 52 extends along the first axis X. The first switch 46 is electrically connected to the electronic circuitry 14 via wires 58 as shown in FIG. 3.

In addition to the first switch 46, the sensor 12 of the first embodiment comprises a second switch 60 which is identically configured to the first switch 46. The switch body 62 of the second switch 60 is positioned upon the tubular bosses 42 of the second pair, and secured thereto via the advancement of a fastener 64 such as a screw through the switch body 62 and into one of the tubular bosses 42 of the second pair. Extending perpendicularly from the switch body 62 is a center leaf contact 66 which is disposed between and in spaced, generally parallel relation to a pair of outer leaf contacts 68. The distal end of the center leaf contact 66, which protrudes beyond the distal ends of the outer leaf contacts 68, includes a protective sheath 70 attached thereto. The second switch 60 is attached to the tubular bosses 42 of the second pair such that the center leaf contact 66 extends along the second axis Y. As is best seen in FIGS. 4 and 5, the lengths of the tubular bosses 42 of the second pair exceed those of the tubular bosses 44 of the third pair such that when the switch bodies 48, 62 are attached to the tubular bosses 44, 42 of the third and second pairs, respectively, the protective sheath 70 attached to the distal end of the center leaf contact 66 of the second switch 60 is disposed immediately above the protective sheath 56 attached to the distal end of the center leaf contact 52 of the first switch 46. The second switch 60 is electrically connected to the electronic circuitry 14 via wires 72 as shown in FIG. 3.

The sensor 12 of the first embodiment further comprises a first actuator 74 which is pivotally connected to the base mount 34. As is best seen in FIG. 5, the first actuator 74 comprises a first section 76 having a recess or a notch 78 formed in one end thereof. In addition to the first section 76, the first actuator 74 includes an annular second section 80 which is integrally connected to the end of the first section 76 opposite that including the notch 78 formed therein via a pair of struts 82. Attached to the second section 80 is a circularly configured counter-weight 84. Additionally, formed on one side of the first section 76 at approximately the location whereat the struts 82 are connected thereto is a cylindrically configured hub portion 86. Extending axially through the hub portion 86 and the first section 76 is a bore 88.

As best seen in FIGS. 3–5, the first actuator 74 is pivotally connected to that tubular boss 40 of the first pair which is disposed closest to the tubular bosses 42 of the second pair. More particularly, the first section 76 is positioned upon such tubular boss 40 of the first pair such that the bore thereof is coaxially aligned with the bore 88 and the distal end of the center leaf contact 52 of the first switch 46 having the protective sheath 56 attached thereto is recieved into the notch 78. As shown FIG. 4, a fastener such as a pivot pin is preferably advanced through the bore 88 and into the tubular boss 40 to complete the pivotal connection of the first actuator 74 to the base mount 34. The first actuator 74, when pivotally connected to the base mount 34, extends along the first axis X.

In addition to the first actuator 74, the sensor 12 of the first embodiment includes a second actuator 90 which is identically configured to the first actuator 74. In this respect, the second actuator 90 includes a first section 92 having a recess or notch 94 formed in one end thereof, with the end of the first section 92 opposite that including the notch 94 formed therein being integrally connected to an annular second section 96 via a pair of struts 98. Attached to the second section 96 is a circularly configured counter-weight 100, while formed on and extending from one side of the first section 92 is a cylindrically configured hub portion 102. Extending axially through the hub portion 102 and first section 92 is a bore 104.

The second actuator 90 is pivotally connected to the remaining tubular boss 40 of the first pair. As is most apparent from FIGS. 4 and 5, the second actuator 90 is "flipped over" relative to the first actuator 74 such that the hub portion 102, as opposed to the first section 92, directly contacts the corresponding tubular boss 40 of the first pair. Thus, when the second actuator 90 is pivotally connected to such tubular boss 40 by advancing a fastener such as a pivot pin through the bore 104 and the bore of the tubular boss 40 coaxially aligned therewith, the second actuator 90 will be elevated above the first actuator 74. Such increased elevation allows for the receipt of the center leaf contact 66 of the second switch 60 having the protective sheath 70 attached thereto into the notch 94 within the first section 92 of the second actuator 90. When pivotally connected to the base mount 34, the second actuator 90 extends along the second axis Y.

Importantly, the lengths of the tubular bosses 40, 42, 44 of the first, second and third pairs and lengths of the hub portions 86, 102 are sized relative to each other such that when the first and second switches 46, 60 and first and second actuators 74, 90 are each attached to the base mount 34, the second switch 60 and corresponding second actuator 90 will extend along the second axis Y at a greater elevation relative to the top surface 36 of the base mount 34 than the first switch 46 and corresponding first actuator 74 extending along the first axis X. This elevational difference allows the center leaf contact 52 of the first switch 46 to pass underneath the center leaf contact 66 of the second switch 60. As will be recognized, these relative elevations and positions of the first and second switches 46, 60 and corresponding first and second actuators, 74, 90 relative to each other minimizes the profile of the sensor 12.

Having thus described the structural attributes of the sensor 12, its manner of operation will now be discussed with particular reference to FIGS. 3 and 4. As indicated above, the first axis X and the second axis Y extend in generally perpendicular relation to each other. When the sensor 12 is oriented such that the first and second axes X, Y each extend in generally parallel relation to reference plane, both the first actuator 74 and the second actuator 90 assume a "home" position whereat the center leaf contact 52 of the first switch 46 does not contact either of the outer leaf contacts 54, and the center leaf contact 66 of the second switch 60 does not contact either of the outer leaf contacts 68. However, moving (e.g., turning, rotating) the sensor 12 to a position whereat at least one of the first and second axes X, Y extends in non-parallel relation to the reference plane will result in at least one of the first and second actuators 74, 90 pivoting from its home position to a "trigger" position whereat at least one of the center leaf contacts 52, 66 of the first and second switches 46, 60 will make contact with one of the outer leaf contacts 54, 68 of the corresponding pair.

For example, as seen in FIG. 3, assuming the first and second axes X, Y are initially oriented to extend in parallel relation to the reference plane, if the sensor 12 were to be rotated about the second axis Y in the direction Y1, the first axis X would be shifted to extend in non-parallel relation to the reference plane. Though the second axis Y continues to extend in parallel relation to the reference plane, the movement of the first axis X causes the force of gravity to act against the counter-weight 100 of the second actuator 90 which results in the counter-clockwise rotation of the second actuator 90 out of its home position into one of its trigger positions as viewed from the perspective shown in FIG. 3. More particularly, such rotation of the second actuator 90 causes the first section 92 to act against the center leaf contact 66 of the second switch 60 in a manner resiliently flexing the same into contact with one of the corresponding outer leaf contacts 68. The rotation of the sensor 12' in a direction opposite Y1 would result in the clockwise rotation of the second actuator 90 as viewed from the perspective shown in FIG. 3 as would cause the first section 92 to act against the center leaf contact 66 in a manner achieving contact with the other outer leaf contact 68 of the corresponding pair. Rotating the sensor 12 back to its original position would facilitate the return of the second actuator 90 to its home position whereat the center leaf contact 66 of the second switch 60 would no longer contact either of the corresponding outer leaf contacts 68 of the second switch 60.

The same relative rotations of the first actuator 74 resulting in the movement thereof from its home position to a trigger position whereat the center leaf contact 52 of the first switch 46 contacts one of the corresponding outer leaf contacts 54 would occur if the sensor 12 were to be rotated about the first axis X such that only the second axis Y is moved into non-parallel relation to the reference plane. Moreover, the first and second actuators 74, 90 may concurrently be moved to the trigger position by rotating, positioning or otherwise maneuvering the sensor 12 such that both the first and second axes X, Y extend in non-parallel relation to the reference plane at the same time.

Those of ordinary skill in the art will recognize that the first axis X along which the first switch 46 and corresponding first actuator 74 extend need not necessary extend in generally perpendicular relation to the second axis Y along which the second switch 60 and corresponding second actuator 90 extend. In this respect, the first and second axes X, Y may simply extend in non-parallel relation to each other at an angle of separation less than ninety degrees (90°) or greater than ninety degrees (90°). Indeed, it is only necessary that the first and second axes X, Y do not extend in parallel relation to each other, though the extension thereof in perpendicular relation to each other is optimal for the performance of the sensor 12.

When the sensor 12 is incorporated into an interactive electronic device and electrical power is supplied thereto, no output signal is generated thereby when both the first and second actuators 74, 90 are in their home positions. The movement of at least one of the first and second actuators 74, 90 to one of its trigger positions results in at least one output signal being generated by the sensor 12. Due to each of the first and second switches 46, 60 including three (3) leaf contacts and the first and second actuators 74, 90 extending along two (2) different axes which preferably extend in generally perpendicular relation to each other, the total number of different output signals which may generated by the sensor 12 is three (the number of leaf contacts in each switch) to the second power (representing the total number of axes) less one (representing the absence of an output signal when the first and second actuators 74, 90 are in their home positions) for a total of eight (8) different output signals. As indicated above, each of these output signals will differ depending upon the level/position or orientation of the sensor 12, and hence the interactive electronic device in which it is incorporated, relative to the reference plane. Due to the electrical connection of sensor 12 to the electronic circuitry 14, each of these output signals is communicated to the electronic circuitry 14.

As indicated above, the sensor 12, switches associated with the front door 20 and buttons 24, contact regions 26, on/off switch 28, speaker 30, and LED's of the spaceship 10 are all in electrical communication with the electronic circuitry 14 which receives its power from the batteries within the battery compartment 32. The electronic circuitry 14 shown in FIG. 9 is operative to facilitate the production of audible outputs from the speaker 30 and visual outputs from the LED's alone and/or in combination which correspond to the absence of an output signal and to respective ones of the output signals generated by the sensor 12 and transmitted thereto. In this respect, it is contemplated that the electronic circuitry 14 will be programmed to have a default output responding to the absence of an output signal being generated by the sensor 12, with the default output resulting in the transmission of audible and/or visual outputs. The electronic circuitry 14 also facilitates the production of these visual and/or audible outputs as a result of the opening and closing of the front door 20, depression of any one of the buttons 24, and finger-tip contact against any one of the contact regions 26. Thus, the spaceship 12 (or any other interactive electronic toy) in which the sensor 12 and associated electronic circuitry 14 are incorporated is capable of producing a variety of differing visual and/or audible effects or functions, many of which are responsive to changes in the level/position or orientation of the spaceship 10 relative to a reference plane.

It is contemplated that the electronic circuitry 14 will be programmable, and particularly programmed to produce certain visual and/or audible effects, depending upon which particular switch is actuated and/or which output signals are transmitted thereto from the sensor 12. It is further contemplated that the electronic circuitry 14 may be programmed to produce a selected effect upon a prescribed sequence of supplemental output signals being transmitted thereto from the sensor 12. For example, in the context of the spaceship 10, the electronic circuitry 14 may be programmed to facilitate the production of a selected visual and/or audible output if the nose of the spaceship 10 is first tilted up, then immediately thereafter tilted down.

Figure 10:
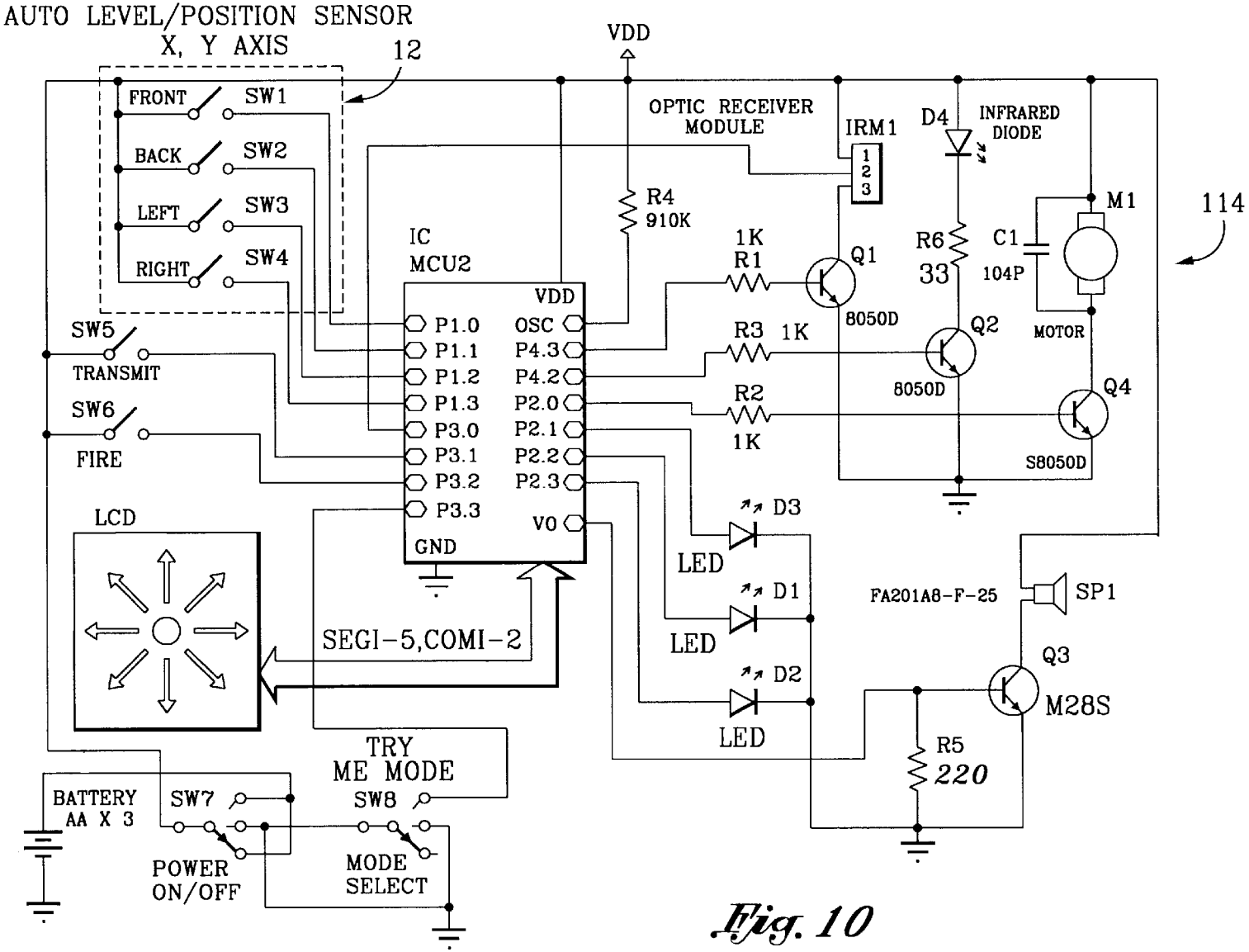
FIG. 10 is a schematic of exemplary electronic circuitry which may be used in conjunction with the sensor of the first embodiment for incorporation into an interactive electronic joystick remote controller.

As also indicated above, the sensor 12 and associated electronic circuitry 14 may be incorporated into an interactive electronic device other than for a toy such as the spaceship 10. Schematically illustrated in FIG. 10 is electronic circuitry 114 which may be employed as an alternative to the electronic circuitry 14 for use in conjunction with the sensor 12 when the sensor 12 is incorporated into an interactive electronic joystick remote controller. This alternative electronic circuitry 114 is designed to facilitate the production of the visual and/or audible outputs as is the case when the sensor 12 is incorporated into an interactive electronic toy or game such as the spaceship 10. The electronic circuitry 114 is also operative to simultaneously translate the absence of an output signal or the output signals generated by the sensor 12 into infrared signals which may be transmitted from the joystick at differing frequencies, with each particular frequency corresponding to a respective output signal. The infrared signals produced by the movement of the joystick remote controller relative to the reference plane may be simultaneously transmitted to another device (e.g., a toy) to facilitate the control and operation thereof in a prescribed manner. As opposed to the joystick remote controller transmitting infrared signals, the electronic circuitry 114 may be configured to transmit radio signals of differing frequencies, microwave signals of differing frequencies, or any combinations thereof.

Figure 11:
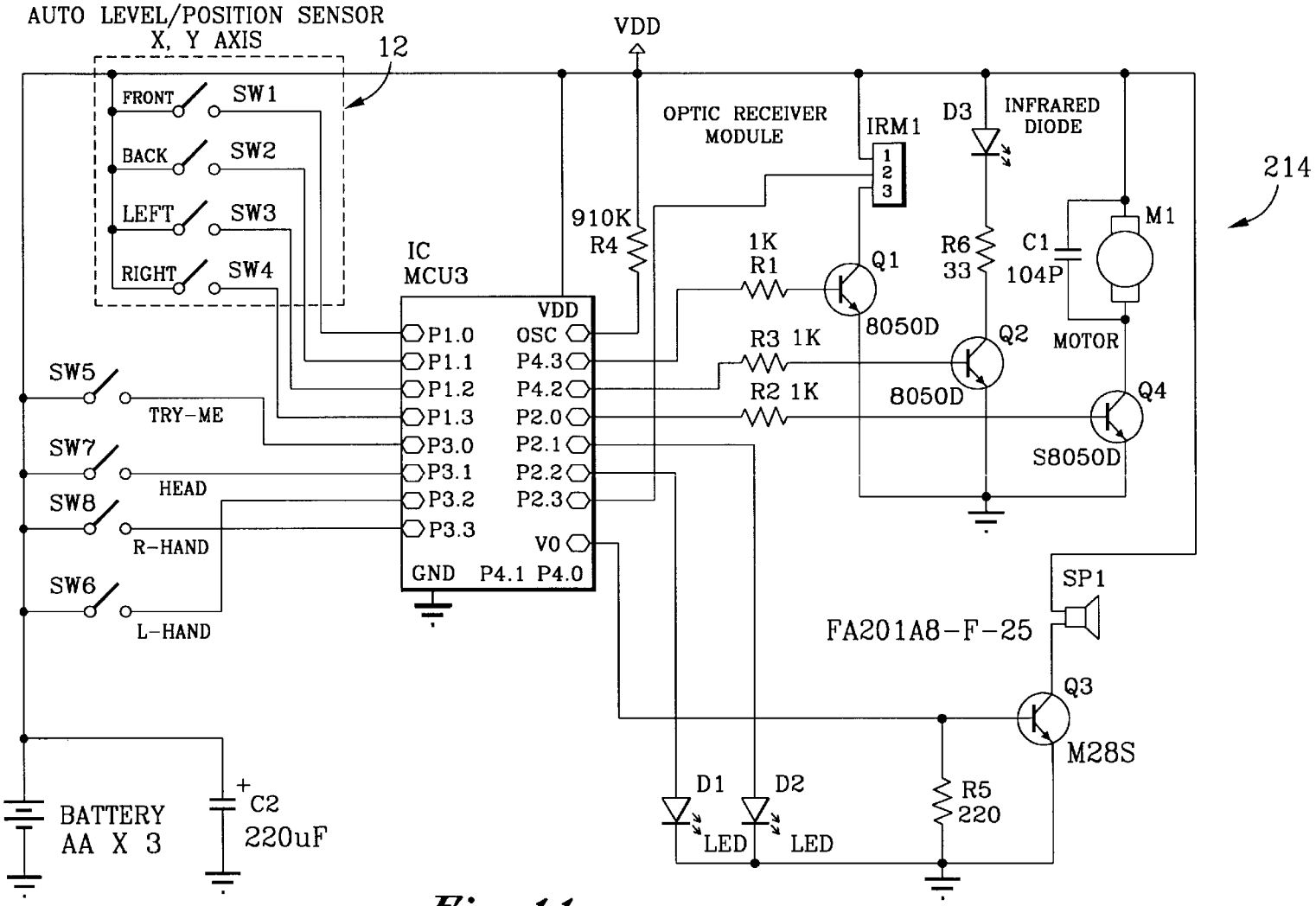
FIG. 11 is a schematic of exemplary electronic circuitry which may be used in conjunction with the sensor of the first embodiment for incorporation into an interactive electronic doll.

Referring now to FIG. 11, schematically illustrated is electronic circuitry 214 which is a further variation of the electronic circuitry 14, and is adapted for use in conjunction with the sensor 12 when the same is incorporated into an interactive electronic doll. The electronic circuitry 214 may be used to facilitate the production of various visual and/or audible outputs from the doll corresponding to particular movements thereof ,z relative to the reference plane, and/or to cause the doll to transmit infrared, radio, or microwave signals of differing frequencies to another doll or toy in the above-described manner to facilitate the control and operation thereof. The frequencies of the infrared, radio, or microwave signals transmitted by the doll will correspond the absence of an output signal and to respective ones of the output signals generated by the sensor 12 and transmitted to the electronic circuitry 214.

Figure 6:
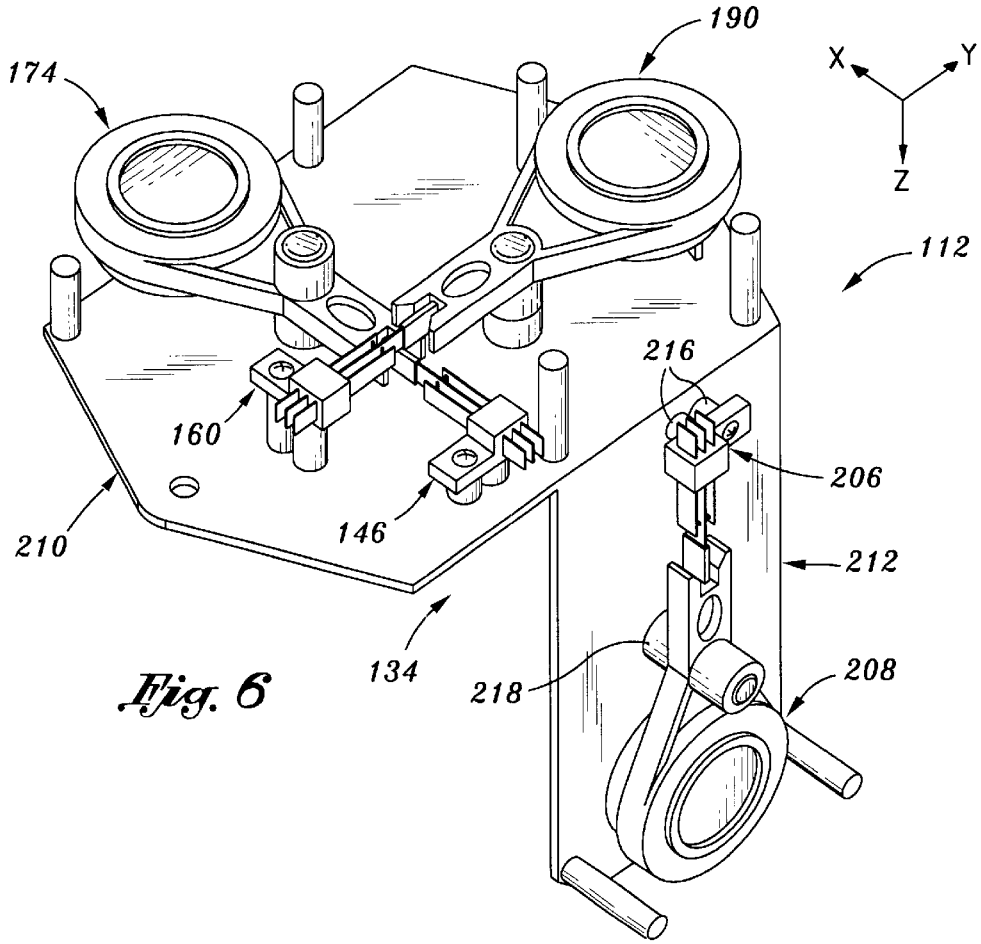
FIG. 6 is a perspective view of a sensor constructed in accordance with a second embodiment of the present invention.

Referring now to FIG. 6, there is shown the sensor 112 constructed in accordance with the second embodiment of the present invention. The sensor 112 essentially comprises the aforementioned sensor 12 with the addition of a third switch 206 and a third actuator 208 which are cooperatively engagable to each other and extend along a third axis Z which extends in generally perpendicular relation to the first and second axes X,Y.

The sensor 112 comprises a base mount 134 including a primary section 210 and a secondary section 212. The secondary section 212 extends generally perpendicularly relative to the primary section 210, with the primary section 210 defining the first axis X and the second axis Y which extend in generally perpendicular relation to each other. The primary section 210 of the base mount 134 is identically configured to the base mount 34. Attached to the primary section 210 is a first switch 146 and a second switch 160. The first and second switches 146, 160 are identically configured to each other, and to the first and second switches 46, 60 described in relation to the sensor 12. Additionally, pivotally connected to the primary section 210 is a first actuator 174 and a second actuator 190 which are identically configured to each other and to the first and second actuators 74, 90 described in relation to the sensor 12. The first switch 146 and first actuator 174 extend along the first axis X and are cooperatively engagable to each other in the same manner previously described in relation to the first switch 46 and first actuator 74 of the sensor 12. Similarly, the second switch 160 and second actuator 190 extend along the second axis Y and are cooperatively engagable to each other in the same manner as previously described in relation to the second switch 60 and second actuator 90 of the sensor 12.

The third switch 206 is itself identically configured to the first and second switches 146, 160, and is positioned upon and attached to a pair of tubular bosses 216 formed on and extending outwardly from the secondary section 212 of the base mount 134. The tubular bosses 216 are sized and configured identically to the tubular bosses 44 of the third pair described above in relation to the sensor 12. The third actuator 208 is identically configured to the first and second actuators 174, 190, and hence the first and second actuators 74, 90 of the sensor 12. The manner in which the third actuator 208 is cooperatively engagable to the third switch 206 is identical to that previously described in relation to the first and second switches 46, 60 and first and second actuators 74, 90 of the sensor 12 of the first embodiment. As is seen in FIG. 6, the secondary section 212 of the base mount 134 also includes a cylindrically configured tubular boss 218 protruding outwardly therefrom which is identically configured to one of the above-described tubular bosses 40 of the first pair in the sensor 12. The third actuator 208 is pivotally connected to the tubular boss 218 in the same manner previously described in relation to the pivotal connection of the first actuator 74 to one of the tubular bosses 40 of the first pair.

As will be recognized by those of ordinary skill in the art, the sensor 112 of the second embodiment, due to its inclusion of the third switch 206 and third actuator 208 extending along the third axis Z, is capable of producing a larger number of output signals as compared to the sensor 12 of the first embodiment. The sensor 112 of the second embodiment does not generate an output signal when the first axis X and second axis Y each extend in generally parallel relation to a reference plane, and the third axis Z extends in generally perpendicular relation to such reference plane. When the first, second and third axes X, Y, Z are disposed in these particular orientation the first, second and third actuators 174, 190, 208 will each be disposed in their home position. Because each of the first, second and third switches 146, 160, 206 includes three (3) leaf contacts and the first, second and third actuators 174, 190, 208 extend along three different axes, the sensor 112 of the second embodiment is capable of producing three (representing the number of leaf contacts in each of the switches) to the third power (representing the total number of axes) output signals less one (representing the absence of an output signal when each of the actuators is in its home position), for a total of twenty-six (26) output signals. Thus, the addition of the third switch 206 and third actuator 208 extending along the third axis Z essentially triples the number of output signals that may be produced by the sensor 112 in comparison to the sensor 12 of the first embodiment. Those of ordinary skill in the art will recognize that the third axis Z need not necessarily extend in generally perpendicular relation to the first and second axes X, Y, but rather may simply extend in non-parallel relation thereto, though it is preferable that the angle of separation be approximately ninety degrees (90°).

Figure 12:
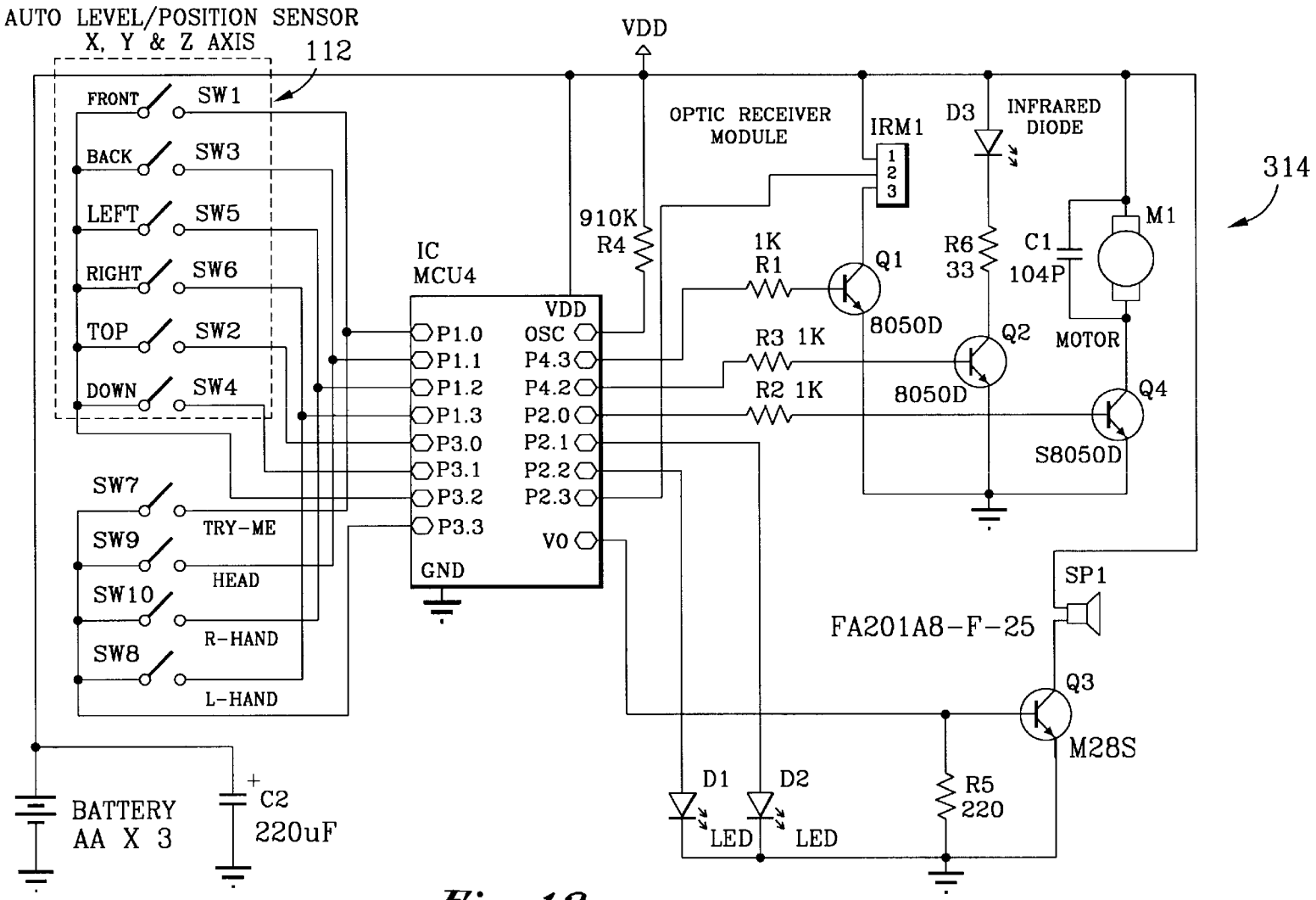
FIG. 12 is a schematic of exemplary electronic circuitry which may be used in conjunction with the sensor of the second embodiment for incorporation into an interactive electronic doll.

Referring now to FIG. 12, there is schematically illustrated electronic circuitry 314 which may be used in conjunction with the sensor 112 of the second embodiment when the same is incorporated into an interactive electronic device, and more particularly an interactive doll. The electronic circuitry 314 is similar in functional capability to the electronic circuitry 214 discussed above, but is modified so as to accept the greater number of output signals from the three-axis sensor 112 of the second embodiment. The above-described electronic circuitry 214, though also being intended for use in an interactive doll, is configured to accept the lesser number of output signals as generated by the two-axis sensor 12 of the first embodiment.

Figure 7:
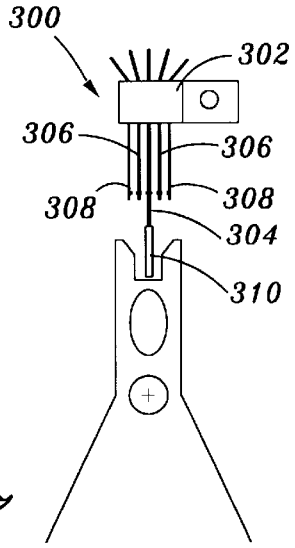
FIG. 7 is a top view of an alternative embodiment of a switch which may be incorporated into the sensors of either the first or second embodiments.
Figure 8:
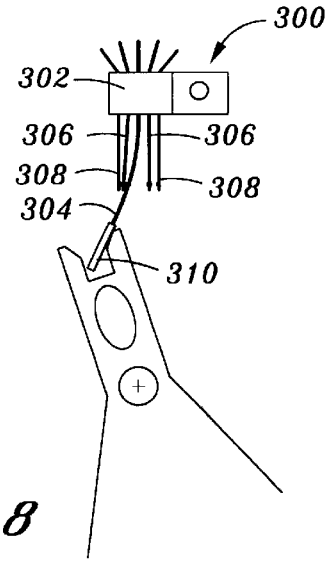
FIG. 8 is a top view of the switch shown in FIG. 7, illustrating an exemplary manner in which such switch is actuated by the movement of the sensor.

Referring now to FIGS. 7 and 8, there is depicted a switch 300 which may be incorporated into the sensor 12 of the first embodiment as an alternative to each of the first and second switches 46, 60, and in the sensor 112 of the second embodiment as an alternative to each of the first, second and third switches 146, 160, 206. The switch 300 includes a switch body 302 which is identically configured to the switch bodies 48, 62 as described above in relation to the sensor 12. However, rather than including only three leaf contacts, the switch 300 includes five (5) leaf contacts including a center leaf contact 304 which extends between and in spaced, generally parallel relation to a pair of inner leaf contacts 306 and a pair of outer leaf contacts 308. The length of the center leaf contact 304 exceeds those of the inner and outer leaf contacts 306, 308, such that the distal end of the center leaf contact 304 protrudes beyond the distal ends of the inner and outer leaf contact 306, 308. Attached to the distal end of the center leaf contact 304 is a protective sheath 310.

As seen in FIG. 8, either the first or second actuator 74, 90 of the sensor 12 or any one the first, second and third actuators 174, 190, 208 of the sensor 112 will act against the center leaf contact 304 in a similar manner to that described in relation to the three leaf contact switches. However, a slight amount of rotation of one of the aforementioned actuators from its home position to its trigger position will result in the center leaf contact 304 of the switch 300 being placed into contact with only one of the corresponding pair of inner leaf contacts 306. A greater amount and/or force of rotation will result in the inner leaf contact 306 of the pair against which the center leaf contact 304 is abutted to itself be flexed into contact with the outer leaf contact 308 of the corresponding pair which is disposed adjacent thereto.

Figure 13:
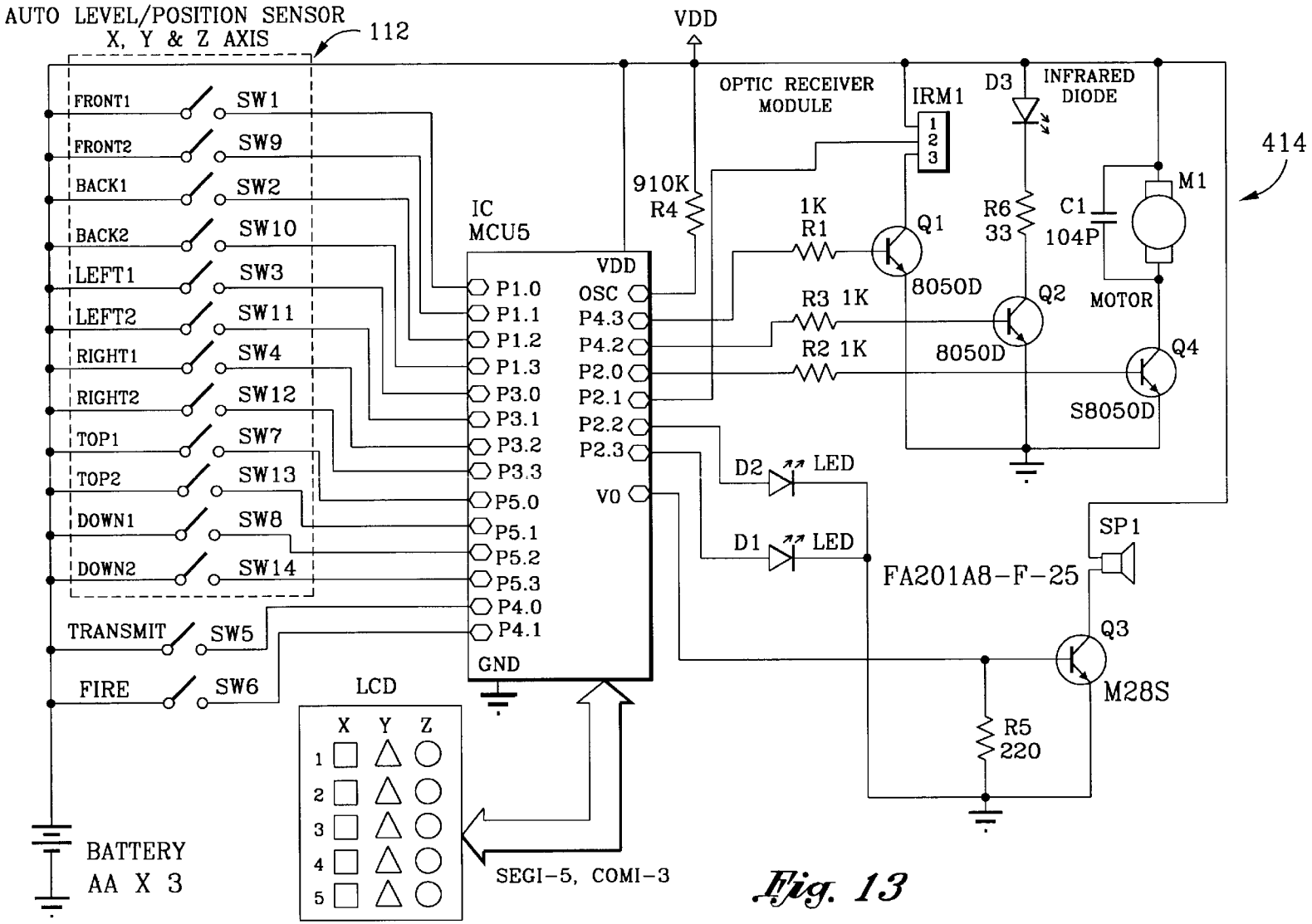
FIG. 13 is a schematic of exemplary electronic circuitry which may be used in conjunction with the sensor of the second embodiment as modified to include the alternative switch shown in FIG. 7 for incorporation into an interactive electronic joystick remote controller.

Based on the foregoing, the inclusion of the switches 300 in the sensor 12 as an alternative to the first and second switches 46, 60 imparts to the sensor 12 the ability to generate five (representing the number of leaf contacts in each switch) to the second power (representing the total number of axes) output signals less one (representing the absence of an output signal when each of the actuators is in its home position), for a total of twenty-four (24) output signals. The substitution of the switches 300 for the first, second and third switches 146, 160, 206 of the sensor 112 imparts to the sensor 112 the ability to generate five (representing the number of leaf contacts in each of the switches) to the third power (representing the total number of axes) output signals less one (representing the absence of an output signal when the actuators are each in their home positions), for a total of one hundred twenty-four (124) output signals. FIG. 13 schematically illustrates electronic circuitry 414 which may be used in conjunction with the sensor 112 of the second embodiment as outfitted to include the switches 300 in substitution for each of the first, second and third switches 146, 160, 226. The electronic circuitry 414 is specifically configured for use in conjunction with the sensor 112/switch 300 combination when the same is incorporated into the joystick remote controller.

Figure 14A:
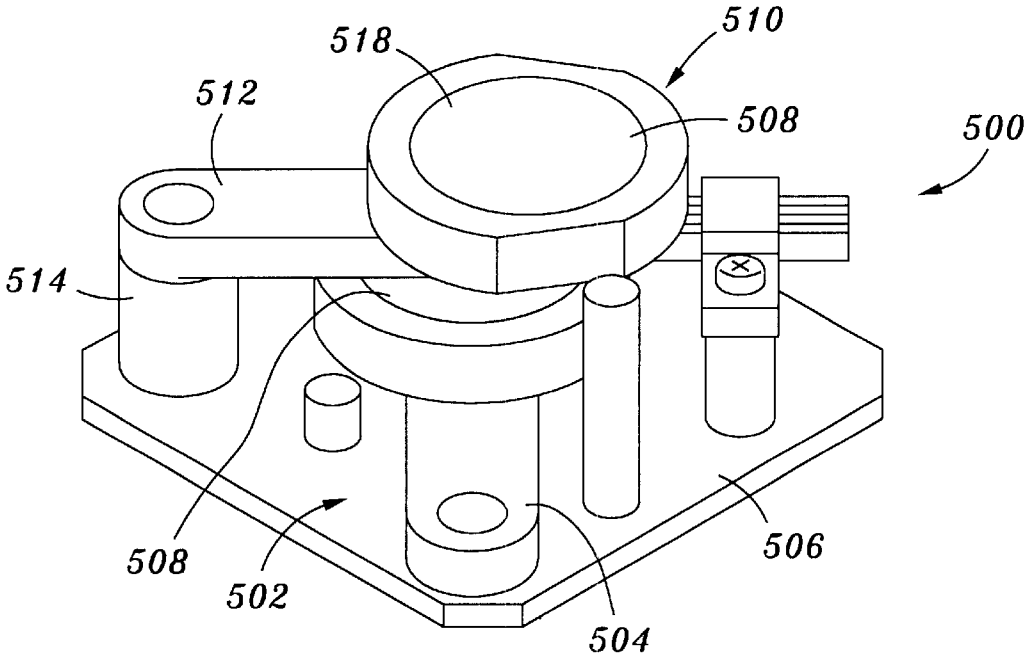
FIG. 14*a* is a perspective view of a sensor constructed in accordance with a third embodiment of the present invention.

Those of ordinary skill in the art will recognize that the sensor 12 and sensor 112 may be modified to have differing configurations without departing from the spirit and scope of the present invention. For example, referring now to FIGS. 14*a* and 14*b*, there is depicted a sensor 500 comprising a first actuator 502 having a fist section 504, one end of which is pivotally connected to a base plate 506, with the opposite end of the first section 504 having a notch formed therein. In addition to the first section 504, the first actuator 502 includes a counter-weight 508 which is attached to the first section 504 immediately above the notch formed in the end thereof opposite that pivotally connected to the base plate 506.

Figure 14B:
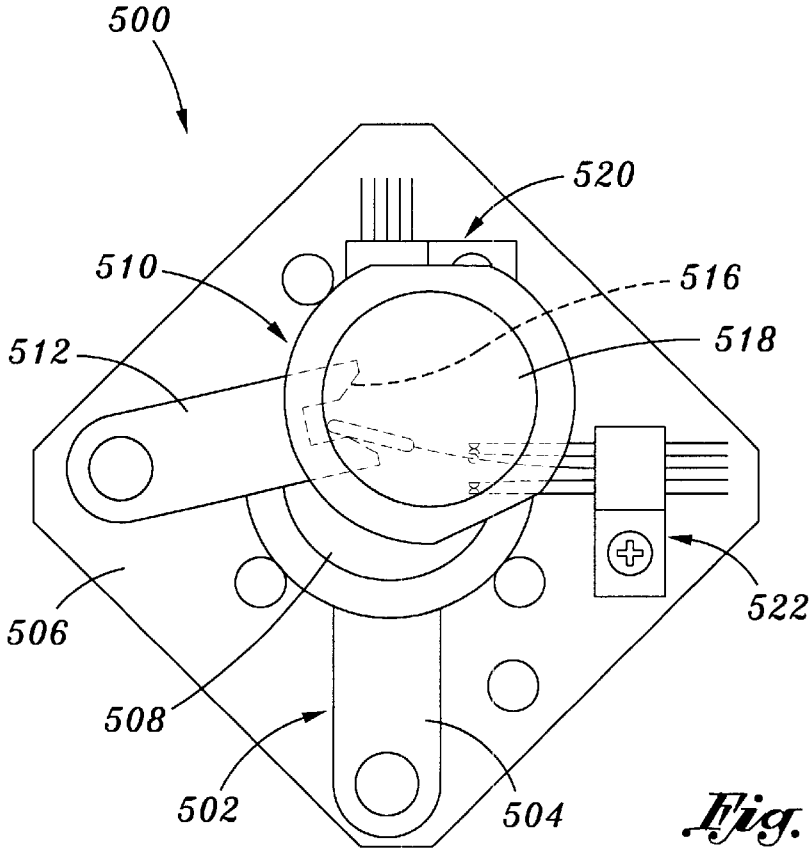
FIG. 14*b* is a top view of the sensor of the third embodiment shown in FIG. 14*a*, illustrating in phantom one of the actuators thereof in its trigger position.

The sensor 500 also includes a second actuator 510 which is identically configured to the first actuator 512 In this respect, the second actuator 510 includes a first section 512 having one end which is pivotally connected to a tubular boss 514 extending perpendicularly upward from the top surface of the base plate 506. The opposite end of the first section 512 includes a notch 516 formed therein. Attached to the first section 512 immediately above the notch 516 is a counter-weight 518 of the second actuator 510. The first actuator 502 is cooperatively engaged to a first switch 520, with the second actuator 510 being cooperatively engaged to a second switch 522. The first and second switches 520, 522 are each attached to the base plate 506, and are identically configured to the above described first and second switches 46, 60. Additionally, the manner in which the first sections 504, 512 of the first and second actuators 502, 510 cooperatively engage respective ones of the switches 520, 522 occurs in the same manner described above through the receipt of the protective sheaths disposed on the ends of the center leaf contacts of the switches 520, 522 into respective ones of the notches within the first sections 504, 512. As is best seen in FIG. 14*b*, the first actuator 502 and accompanying first switch 520 and second actuator 510 and accompanying second switch 522 extend along respective axes which extend in generally perpendicular relation to each other when the first and second actuators 502, 510 are each in their home position. In the sensor 500, the construction thereof such that the counter-weights 508, 518 are disposed above the notches in respective ones of the first sections 504, 512 reduces the length of the first and second actuators 502, 510 by approximately one-half in comparison to those discussed above in relation to the prior embodiments of the present sensor.

Figure 15A:
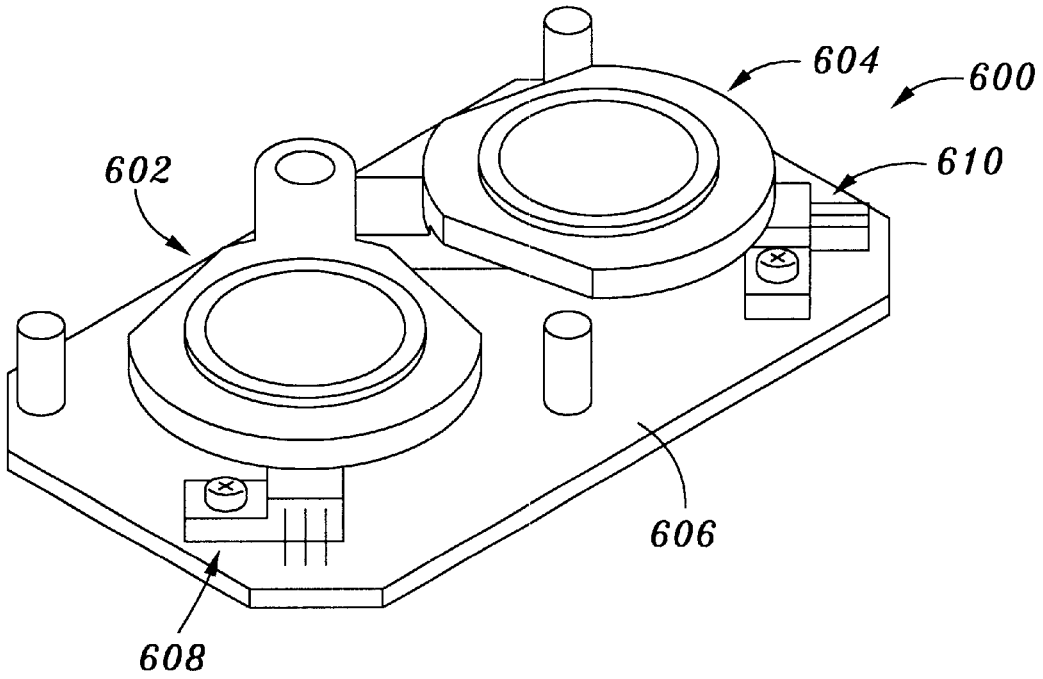
FIG. 15*b* is a top view of the sensor of the fourth embodiment shown in FIG. 15*a*, illustrating each of the actuators thereof in their trigger positions.
Figure 15B:
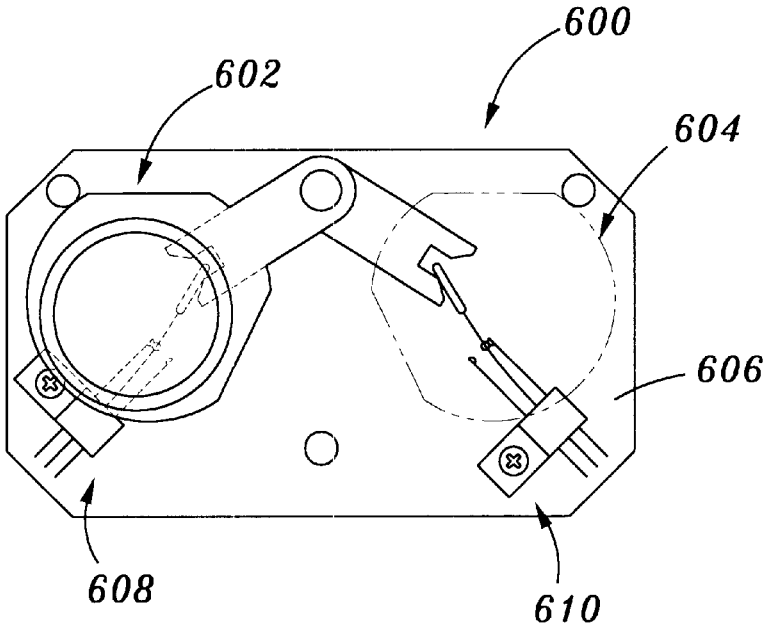

Referring now to FIGS. 15*a* and 15*b*, there is depicted a sensor 600 comprising first and second actuators 602, 604 which are similarly configured to the first and second actuators 502, 510 described in relation to the sensor 500.

The first and second actuators 602, 604 are pivotally connected to a base plate 606 of the sensor 600 at a common pivot point, and cooperatively engaged to respective ones of first and second switches 608, 610 of the sensor 600 which are each attached to the base plate 606 and identically configured to the switches 520, 522 described in relation to the sensor 500. When the first and second actuators 602, 604 are each in their home position, they and their corresponding switches 608, 610 extend along respective axes which are oriented in generally perpendicular relation to each other. Each of the first and second actuators 602, 604 is cooperatively engaged to a respective one of the first and second switches 608, 610 in a manner similar to that previously described in relation to the cooperative engagement of the first and second actuators 502, 510 of the sensor 500 to respective ones of the first and second switches 520, 522 thereof.

The modifications described in relation to the sensors 500, 600 are for purposes of minimizing the overall profile thereof. In the sensor 500, the profile is minimized by the reduced sizes of the first and second actuators 502, 510 thereof. In the sensor 600, the first and second actuators 602, 604 are also of a smaller size, with the profile of the sensor 600 also being reduced by the first and second actuators 602, 604 sharing a common pivot point. Those of ordinary skill in the art will recognize that the modifications reflected in the sensors 500, 600 are not exhaustive of the manners in which the actuators and switches of the sensor may be reconfigured for purposes of minimizing the overall profile thereof. As will be recognized, the ultimate configuration of the sensor will largely be dependant upon the configuration or spacial allotment of the particular interactive electronic device in which it is to be incorporated.

Additional modifications and improvements of the present invention may also be apparent to those of ordinary skill in the art. For example, the actuators and switches of the various sensors discussed above need not necessarily be attached to a common base mount. In this respect, the various actuators and switches may be attached to two or more separate base mounts or similar support structures which are arranged relative to each other as needed to achieve the necessary orientations of the actuators relative to respective ones of the switches. Thus, the particular combination of parts described and illustrated herein is intended to represent only certain embodiments of the present invention, and is not intended to serve as limitations of alternative devices within the spirit and scope of the invention.

What is claimed is:

1. In an interactive electronic device, the improvement comprising:

a sensor disposed within the device and comprising:

at least two actuators movably attached to the device and extending along respective ones of first and second axes which are non-parallel to each other;

the sensor being operative to generate no output signal when the device resides on a device plane whereat the first and second axes extend in generally parallel relation to a reference plane, and at least one output signal when the device is moved to reside on a function plane whereat at least one of the first and second axes extends in non-parallel relation to the reference plane.

2. The device of claim 1 wherein the device is movable so as to reside on any one of a multiplicity of function planes which each extend in non-parallel relation to the reference plane, and the sensor is operative to generate a multiplicity of different output signals corresponding to respective ones of the function planes.

3. The device of claim 2 wherein the improvement further comprises programmable electronic circuitry which is in electrical communication with the sensor and programmed to translate the absence of an output signal and any output signals generated by the sensor into respective effects.

4. The device of claim 3 wherein the electronic circuitry is further programmed to produce a selected effect upon a prescribed sequence of output signals being transmitted thereto from the sensor.

5. A sensor for use in an interactive electronic device and operative to generate a multiplicity of different output signals corresponding to respective positions of the sensor relative to a plane, the sensor comprising:

a base mount;

a first switch attached to the base mount and including at least two leaf contacts extending in juxtaposed relation to each other;

a first actuator movably attached to the base mount and cooperatively engaged to one of the leaf contacts of the first switch, the first actuator normally extending along a first axis and being movable relative thereto from a home position whereat none of the leaf contacts of the first switch contact each other to a trigger position whereat the leaf contact to which the first actuator is cooperatively engaged contacts at least one other leaf contact of the first switch;

a second switch attached to the base mount and including at least two leaf contacts extending in juxtaposed relation to each other; and a second actuator movably attached to the base mount and cooperatively engaged to one of the leaf contacts of the second switch, the second actuator normally extending along a second axis which extends in non-parallel relation to the first axis and being movable relative to the second axis from a home position whereat none of the leaf contacts of the second switch contact each other to a trigger position whereat the leaf contact to which the second actuator is cooperatively engaged contacts at least one other leaf contact of the second switch;

the sensor being configured such that when the first and second axes extend in generally parallel relation to the plane, the first and second actuators are each disposed in the home position resulting in no output signal being generated by the sensor, with the movement of the sensor in a manner wherein at least one of the first and second axes extends in non-parallel relation to the plane causing at least one of the first and second actuators to move to the trigger position resulting in at least one output signal being generated by the sensor.

6. The sensor of claim 5 wherein:

the first and second switches each comprise a center leaf contact disposed between a pair of outer leaf contacts; and the first and second actuators are cooperatively engaged to the center leaf contact of respective ones of the first and second switches.

7. The sensor of claim 5 wherein:

the first and second switches each comprise a center leaf contact disposed between two pairs of outer leaf contacts; and the first and second actuators are cooperatively engaged to the center leaf contact of respective ones of the first and second switches.

8. The sensor of claim 5 wherein:

the leaf contacts of the first and second switches each define a distal end; and the leaf contact of each of the first and second switches to which a respective one of the first and second actuators is cooperatively engaged is sized such that the distal end thereof protrudes beyond the distal ends of the remaining leaf contacts.

9. The sensor of claim 8 wherein the first and second actuators each comprise:

a first end having a recess formed therein sized and configured to receive the distal end of the leaf contact of a respective one of the first and second switches which protrudes beyond the distal ends of the remaining leaf contacts;

a second end having a counter-weight attached thereto; and a central hub which is disposed between the first and second ends and pivotally connected to the base mount.

10. The sensor of claim 9 wherein the first and second switches each comprise a protective sheath attached to the distal end of the leaf contact received into the recess disposed within the first end of a respective one of the first and second actuators.

11. The sensor of claim 5 further in combination with electronic circuitry which is in electrical communication with the sensor and operative to facilitate the production of effects corresponding to the absence of an output signal and any output signal generated by the sensor and transmitted thereto.

12. The sensor of claim 11 wherein the electronic circuitry is programmable, and is programmed to produce a selected effect upon a prescribed sequence of supplemental output signals being transmitted thereto from the sensor.

13. A sensor for use in an interactive electronic device and operative to generate a multiplicity of different output signals corresponding to respective positions of the sensor relative to a plane, the sensor comprising:

a base mount;

a first switch attached to the base mount and including at least two leaf contacts extending in juxtaposed relation to each other;

a first switch actuator movably attached to the base mount and cooperatively engaged to one of the leaf contacts of the first switch, the first actuator normally extending along a first axis and being movable relative thereto from a home position whereat none of leaf contacts of the first switch contact each other to a trigger position whereat the leaf contact to which the first actuator is cooperatively engaged contacts at least one other leaf contact of the first switch;

a second switch attached to the base mount and including at least two leaf contacts extending in juxtaposed relation to each other;

a second actuator movably attached to the base mount and cooperatively engaged to one of the leaf contacts of the second switch, the second actuator normally extending along a second axis which extends in non-parallel relation to the first axis and being movable relative to the second axis from a home position whereat none of the leaf contacts of the second switch contact each other to a trigger position whereat the leaf contact to which the second actuator is cooperatively engaged contacts at least one other leaf contact of the second switch;

a third switch attached to the base mount and including at least two leaf contacts extending in juxtaposed relation to each other; and a third actuator movably attached to the bake mount and cooperatively engaged to one of the leaf contacts of the third switch, the third actuator normally extending along a third axis which extends in non-parallel relation to the first and second axes and being movable relative to the third axis from a home position whereat none of the leaf contacts of the third switch contact each other to a trigger position whereat the leaf contact to which the third actuator is cooperatively engaged contacts at least one other leaf contact of the third switch;

the sensor being configured such that when the first and second axes extend in generally parallel relation to the plane and the third axis extends in non-parallel relation to the plane, the first, second and third actuators are each disposed in the home position resulting in no output signal being generated by the sensor, with the movement of the sensor such that at least one of the first and second axes extends in non-parallel relation to the plane causing at least one of the first, second and third actuators to move to the trigger position resulting in at least one output signal being generated by the sensor.

14. The sensor of claim 13 wherein:

the first, second and third switches each comprise a center leaf contact disposed between a pair of outer leaf contacts; and a first, second and third actuators are cooperatively engaged to the center leaf contact of respective ones of the first, second and third switches.

15. The sensor of claim 13 wherein:

the first, second and third switches each comprise a center leaf contact disposed between two pairs of outer leaf contacts; and the first, second and third actuators are cooperatively engaged to the center leaf contact of respective ones of the first, second and third switches.

16. The sensor of claim 13 wherein:

the leaf contacts of the first, second and third switches each define a distal end; and the leaf contact of each of the first, second and third switches to which a respective one of the first, second and third actuators is cooperatively engaged is sized such that the distal end thereof protrudes beyond the distal ends of the remaining leaf contacts.

17. The sensor of claim 16 wherein the first, second and third actuators each comprise:

a first end having a recess formed therein sized and configured to receive the distal end of the leaf contact of a respective one of the first, second and third switches which protrudes beyond the distal ends of the remaining leaf contacts;

a second end having a counter-weight attached thereto; and a central hub which is disposed between the first and second ends and pivotally connected to the base mount.

18. The sensor of claim 17 wherein the first, second and third switches each comprise a protective sheath attached to the distal end of the leaf contact received into the recess disposed within the first end of a respective one of the first, second and third actuators.

19. The sensor of claim 13 further in combination with electronic circuitry which is in electrical communication with the sensor and operative to facilitate the production of effects corresponding to the absence of an output signal and any output signal generated by the sensor and transmitted thereto.

20. The sensor of claim 19 wherein the electronic circuitry is programmable, and is programmed to produce a selected effect upon a prescribed sequence of output signals being transmitted thereto from the sensor.

21. In an interactive electronic device, the improvement comprising:

a sensor disposed within the device and comprising:

at least two actuators movably attached to the device and extending along respective ones of first and second axes which are non-parallel to each other;

the sensor being operative to generate an initial output signal when the device resides on a device plane whereat the first and second axes extend in generally parallel relation to a reference plane, and at least one supplemental output signal differing from the initial output signal when the device is moved to reside on a function plane whereat at least one of the first and second axes extends in non-parallel relation to the reference plane.

22. The device of claim 21 wherein the device is movable so as to reside on any one of a multiplicity of function planes which each extend in non-parallel relation to the reference plane, and the sensor is operative to generate a multiplicity of different supplemental output signals corresponding to respective ones of the function planes.

23. The device of claim 22 wherein the improvement further comprises programmable electronic circuitry which is in electrical communication with the sensor and programmed to translate the initial and supplemental output signals into respective effects.

24. The device of claim 23 wherein the electronic circuitry is further programmed to produce a selected effect upon a prescribed sequence of supplemental output signals being transmitted thereto from the sensor.

* * * * *